US011005205B2

(12) United States Patent
Chen et al.

(10) Patent No.: US 11,005,205 B2
(45) Date of Patent: May 11, 2021

(54) STABLE FEMALE TERMINAL AND STABLE MALE-FEMALE PLUG-IN ELECTRICAL CONNECTOR USING SAME

(71) Applicant: Xiamen GHGM Industrial Trade Co., Ltd., Xiamen (CN)

(72) Inventors: Bingshui Chen, Xiamen (CN); Baohua Huang, Xiamen (CN); Zhihuan Li, Xiamen (CN); Yonglong Li, Xiamen (CN)

(73) Assignee: Xiamen GHGM Industrial Trade Co., Ltd., Xiamen (CN)

( * ) Notice: Subject to any disclaimer, the term of this patent is extended or adjusted under 35 U.S.C. 154(b) by 0 days.

(21) Appl. No.: 16/516,054

(22) Filed: Jul. 18, 2019

(65) Prior Publication Data

US 2020/0381855 A1 Dec. 3, 2020

(30) Foreign Application Priority Data

Jun. 3, 2019 (CN) ..... 201910477960.X
Jul. 5, 2019 (CN) ..... 201921042290.0

(51) Int. Cl.

| | |
|---|---|
| ***H01R 25/00*** | (2006.01) |
| ***H01R 13/11*** | (2006.01) |
| ***H01R 12/57*** | (2011.01) |
| ***H01R 13/04*** | (2006.01) |
| ***H01R 13/631*** | (2006.01) |

(52) U.S. Cl.

CPC ..... *H01R 13/112* (2013.01); *H01R 12/57* (2013.01); *H01R 13/04* (2013.01); *H01R 13/631* (2013.01)

(58) Field of Classification Search

CPC ..... H01R 2105/00; H01R 2103/00; H01R 2101/00; H01R 13/516; H01R 13/415; H01R 13/26; H01R 13/2464; H01R 24/62

USPC ..... 439/284, 441, 835, 483, 58, 88, 295

See application file for complete search history.

(56) References Cited

U.S. PATENT DOCUMENTS 3,091,746 A * 5/1963 Winkler ..... H01R 24/84 439/295
3,452,321 A * 6/1969 Carissimi ..... H01R 13/46 439/483
3,794,957 A * 2/1974 Winkler ..... H01R 13/28 439/295
3,909,099 A * 9/1975 Winkler ..... H01R 13/562 439/295
4,386,818 A * 6/1983 Millhimes ..... H01R 13/7175 439/483

(Continued)

*Primary Examiner* — Abdullah A Riyami
*Assistant Examiner* — Nelson R. Burgos-Guntin
(74) *Attorney, Agent, or Firm* — Cooper Legal Group, LLC

(57) ABSTRACT

A stable female terminal comprises a substrate. Two side edges of the front end of the substrate are turned to form two opposite elastic pieces. A slot allowing a male terminal to be inserted therein is formed between the two elastic pieces. The two elastic pieces draw close to each other to form an elastic jaw used for clamping two sides of the male terminal inserted into the slot. A female terminal external connection part is formed at the rear end of the substrate. Contacts have a large positive force when the male terminal and the female terminal are connected, so that the male terminal and the female terminal can be in contact more stably and reliably, and larger currents can pass through the male terminal and the female terminal.

18 Claims, 18 Drawing Sheets

(56) References Cited

U.S. PATENT DOCUMENTS 4,455,056 A * 6/1984 Herrmann, Jr. ..... H01R 13/53 439/284
4,884,981 A * 12/1989 Chandler ..... H01R 13/6593 439/607.41
4,990,099 A * 2/1991 Marin ..... H01R 13/642 439/284
6,220,891 B1 * 4/2001 Hils ..... H01R 13/6598 439/284
7,420,119 B2 * 9/2008 Janos ..... H01R 25/003 174/53
7,628,640 B2 * 12/2009 Radle ..... H01R 4/5008 439/441
7,727,002 B2 * 6/2010 Bethurum ..... H01R 4/4818 439/441
7,753,718 B2 * 7/2010 Bethurum ..... H01R 24/20 439/441
8,187,023 B1 * 5/2012 Chen ..... H01R 4/22 439/441
8,454,378 B2 * 6/2013 Osterhart ..... H01R 24/84 439/284
9,972,953 B1 * 5/2018 Zamora ..... H01R 13/26
2003/0017741 A1 * 1/2003 Olson ..... G02B 6/3878 439/483
2008/0132109 A1 * 6/2008 Landis ..... H01R 13/639 439/441
2008/0280475 A1 * 11/2008 Byrne ..... H01R 25/167 439/284
2010/0130042 A1 * 5/2010 Gray ..... H01R 4/4818 439/176
2011/0028016 A1 * 2/2011 Toner ..... H01R 24/84 439/284
2012/0088386 A1 * 4/2012 Guo ..... H01R 24/84 439/284
2015/0194745 A1 * 7/2015 Moser ..... H01R 12/515 439/55

* cited by examiner

STABLE FEMALE TERMINAL AND STABLE MALE-FEMALE PLUG-IN ELECTRICAL CONNECTOR USING SAME

BACKGROUND OF THE INVENTION

1. Technical Field

The invention relates to the technical field of electrical connectors, in particular to stable male terminal and a stable male-female plug-in electrical connector using the same

2. Description of Related Art

In the prior art, male terminals and female terminals are electrically connected through wires, but this connection method is complex and has the defect of infirm connection. Or, the male terminals and the female terminals can be conveniently connected through plugging, as shown in FIG. 1 or FIG. 2. However, it can be clearly found by analysis on the terminal structure of existing electrical connectors that convex elastic contacts 110 and 210 are formed at the contact parts of the male terminal 100 and the female terminal 200 in FIG. 1 and FIG. 2, while the elastic contacts 110 and 210 are poor in contact tightness and electrical connection stability and reliability due to their poor elasticity, and thus, need to be improved.

BRIEF SUMMARY OF THE INVENTION

The objective of the invention is to provide a stable female terminal, and a stable male-female plug-in electrical connector which uses the stable female terminal, is simple in structure, and is provided with elastic contacts having a large positive contact force, thereby being more stable and reliable in electrical connection.

The solution adopted by the invention to fulfill the above objective is as follows:

A stable female terminal comprises a substrate, wherein two side edges of the front end of the substrate are turned to form two opposite elastic pieces, a slot allowing a male terminal to be inserted therein is formed between the two elastic pieces, the two elastic pieces draw close to each other to form an elastic jaw used for clamping two sides of the male terminal inserted into the slot, and a female terminal external connection part is formed at the rear end of the substrate.

The two side edges of the front end of the substrate are turned to form the two elastic pieces perpendicular to the substrate, and the front ends of the two elastic pieces are disconnected from the substrate and draw close to each other to form the elastic jaw.

The two side edges of the front end of the substrate are turned to form the two elastic pieces perpendicular to the substrate, and the rear ends of the two elastic pieces are disconnected from the substrate and draw close to each other to form the elastic jaw.

Guide-in faces are formed at foreparts of the two elastic pieces to make the male terminal be smoothly inserted between the two elastic pieces.

The female terminal external connection part is a wire contact elastic piece which is formed by back bending of the rear end of the substrate and is to be electrically connected with an external wire.

Two side edges or one side edge of the wire contact elastic piece of the female terminal external connection part are/is formed with fin(s).

The female terminal external connection part is a weld pin which is formed by bending of the rear end of the substrate and is to be electrically connected with a PCB.

A barb used for installation positioning is formed on the substrate.

A stable male-female plug-in electrical connector comprises a male terminal, a female terminal, a male terminal insulation shell, and a female terminal insulation shell, wherein the male terminal insulation shell and the female terminal insulation shell are each provided with a through cavity, plug ports are formed in one ends of male terminal insulation shell and the female terminal insulation shell, external connection ports are formed in another ends of the male terminal insulation shell and the female terminal insulation shell, and the male terminal insulation shell and the female terminal insulation shell are able to move to be jointed or separated via the plug ports; at least one male terminal is installed in the cavity of the male terminal insulation shell, and at least one female terminal is installed in the cavity of the female terminal insulation shell; the male terminal is provided with a male terminal contact which corresponds to the plug port and is used for plugging and a male terminal external connection part which corresponds to the external connection port, and the female terminal is the stable female terminal; and when the male terminal insulation shell and the female terminal insulation shell move to be jointed, the male terminal contact of the male terminal is inserted into the slot between the two elastic pieces of the female terminal, and the elastic jaw formed by the two elastic pieces clamp the two sides of the male terminal.

Two side edges or one side edge of the wire contact elastic piece of the female terminal external connection part are/is formed with fin(s). An oblique step is formed on the inner side of the external connection port of the female terminal insulation shell to support the fin(s) on the side edge(s) of the wire contact elastic piece, so that the wire contact elastic piece is prevented from being compressively deformed by the wire in contact with the wire contact elastic piece, which may otherwise cause a failure; and through the cooperation of the fin(s) and the step, the wire contact elastic piece is protected, and good contact between the wire contact elastic piece and the wire is guaranteed.

The male terminal comprises a substrate, wherein the front edge of the front end of the substrate is extended and turned back to form an elastic piece, a convex male terminal contact is formed on the elastic piece, and the male terminal external connection part is formed at the rear end of the substrate; and when the male terminal insulation shell and the female terminal insulation shell move to be jointed, the male terminal contact of the male terminal is inserted into the slot between the two elastic pieces of the female terminal and abuts against the bottom of the slot, and the elastic jaw formed by the two elastic pieces clamps the two sides of the male terminal, so that contact-type electrical connection in three directions is realized. The elastic piece protrudes in an arc shape or in a planar shape.

The male terminal external connection part is a wire contact elastic piece which is formed by back bending of the rear end of the substrate and is to be electrically connected with an external wire. Furthermore, two side edges or one side edge of the wire contact elastic piece are/is formed with fin(s), an oblique step is formed on the inner side of the external connection port of the male terminal insulation shell to support the fin(s) on the side edge(s) of the wire contact elastic piece, so that the wire contact elastic piece is prevented from being compressively deformed by the wire in contact with the wire contact elastic piece, which may otherwise cause a failure; and through the cooperation of the fin(s) and the step, the wire contact elastic piece is protected, and good contact between the wire contact elastic piece and the wire is guaranteed.

The male terminal external connection part is a weld pin which is formed by bending of the rear end of the substrate and is to be electrically connected with a PCB.

The male terminal is a common terminal which directly rises to form a male terminal contact used for plugging; and when the male terminal insulation shell and the female terminal insulation shell move to be jointed, the male terminal contact of the male terminal is inserted into the slot between the two elastic pieces of the male terminal and abuts against the bottom of the slot, and the elastic jaw formed by the two elastic pieces clamps the two sides of the male terminal, so that contact-type electrical connection in three directions is realized.

A sectional groove is formed in an end, which is inserted into the elastic jaw of the female terminal, of the male terminal, so that the contact elasticity of the male terminal and the female terminal is made better.

By adoption of the solution, the female terminal is simple in structure and can be formed by one sheet through integral punching and bending. The female terminal is provided with two opposite elastic pieces, and an elastic jaw formed by the two elastic pieces elastically makes contact with the two sides of the male terminal so as to apply a clamping force to the male terminal from the two sides, so that the male terminal and the female terminal are connected; the contacts have a large positive force during connection, so that the male terminal and the female terminal can be in contact more stably and reliably, and larger currents can pass through the male terminal and the female terminal.

The invention is further explained below in combination with the accompanying drawings and embodiments.

REFERENCE SIGNS

Figure 1:
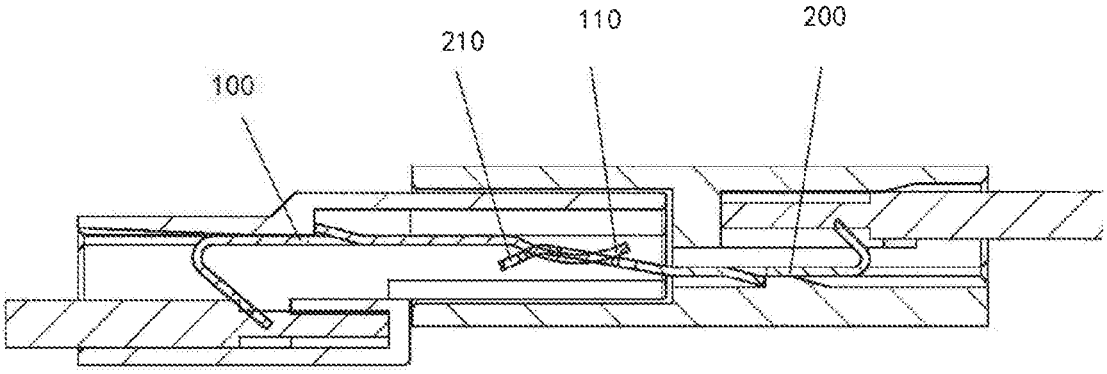
FIG. 1 and FIG. 2 are structural views of two existing male-female plug-in electrical connectors.

100, male terminal; 200, female terminal; 110 and 210, elastic contact;

1, female terminal; 11, substrate; 12, elastic piece; 13, elastic jaw; 14, female terminal external connection part; 141, fin; 15, guide-in face; 16, barb;

2, male terminal; 21, male terminal contact; 211, sectional groove; 22, male terminal external connection part; 221, fin; 23, substrate; 24, elastic piece; 25, barb;

3, female terminal insulation shell; 31, cavity; 32, plug port; 33, external connection port; 331, step;

4, male terminal insulation shell; 41, cavity; 42, plug port; 43, external connection port; 431, step;

5, wire.

DETAILED DESCRIPTION OF THE INVENTION

As shown in FIGS. 3A-7C, the invention discloses a stable female terminal 1, and a stable male-female plug-in electrical connector using the female terminal 1.

As shown in FIGS. 3A-4C, the stable female terminal 1 comprises a substrate 11, wherein two side edges of the front end of the substrate 11 are turned to form two opposite elastic pieces 12, a slot allowing a male terminal 2 to be inserted therein is formed between the two elastic pieces 12, the two elastic pieces 12 draw close to each other to form an elastic jaw 13 used for clamping two sides of the male terminal 2 inserted into the slot, and a female terminal external connection part 14 is formed at the rear end of the substrate 11.

Figure 3A:
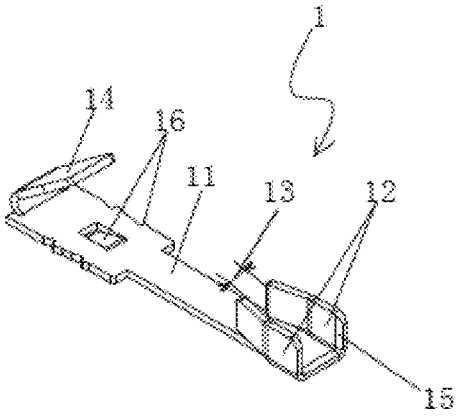
FIG. 3A, FIG. 3B and FIG. 3C are respectively a perspective view, a side view, and a top view of the female terminal in Embodiment 1 of the invention.
Figure 3B:
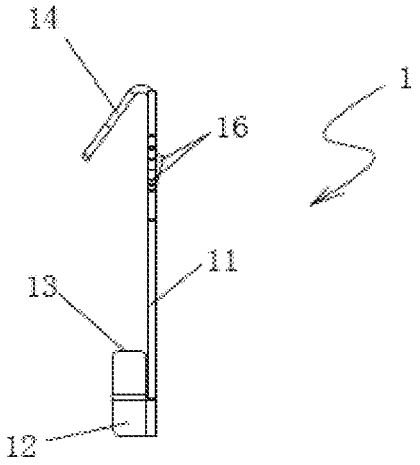
Figure 3C:
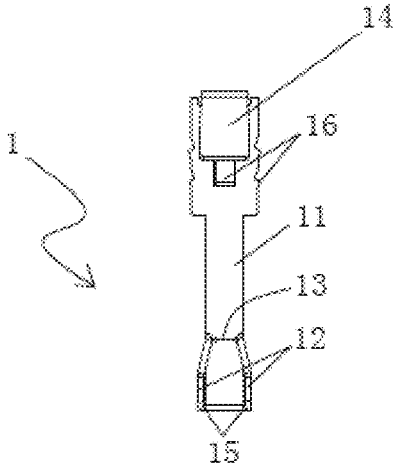
Figure 4A:
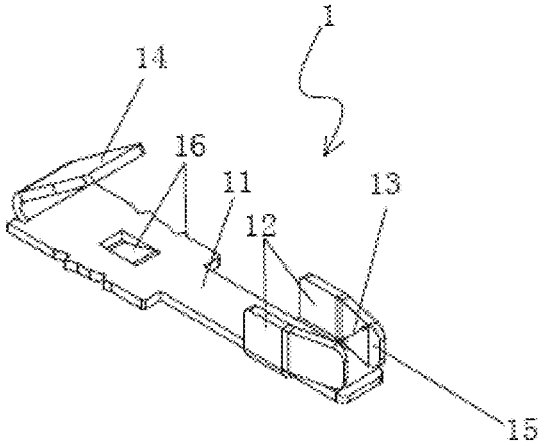
FIG. 4A, FIG. 4B and FIG. 4C are respectively a perspective view, a side view and a top view of the female terminal in Embodiment 2 of the invention.
Figure 4B:
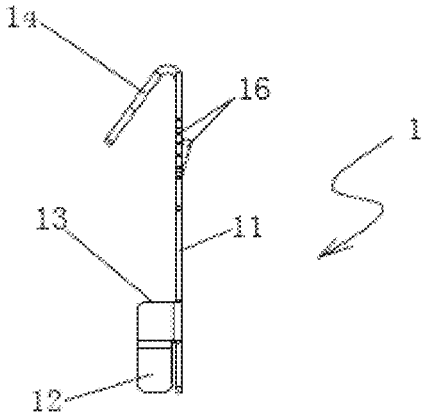
Figure 4C:
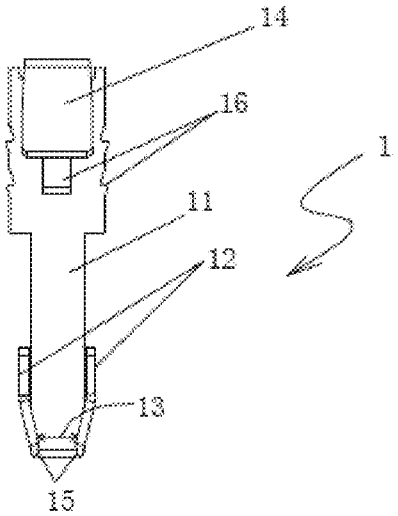
Figure 5A:
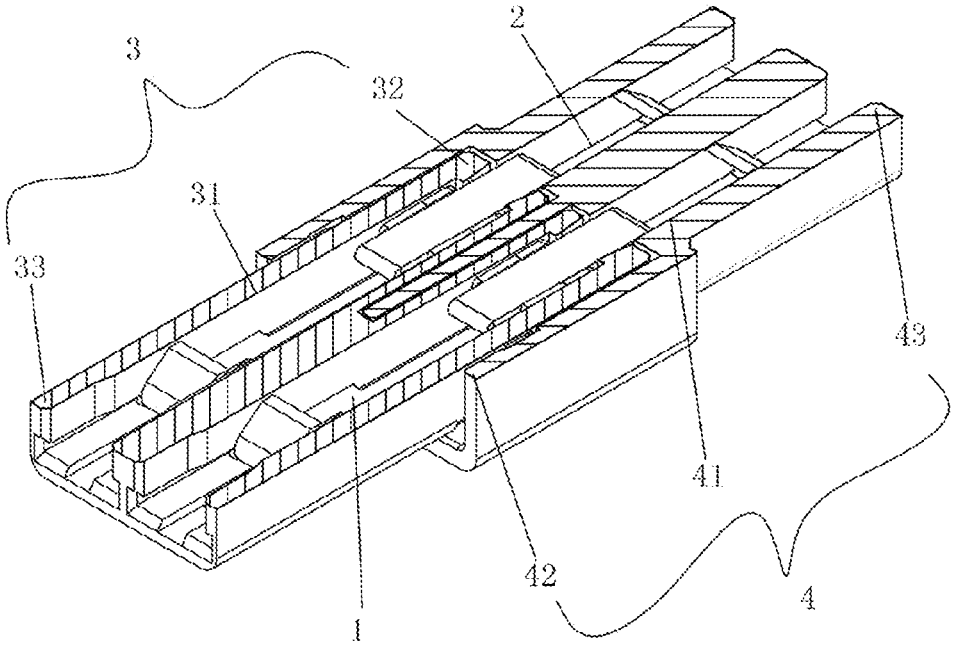
FIG. 5A and FIG. 5B are respectively a perspective sectional view and a top view of a male-female plug-in electrical connector using the female terminal in Embodiment 1 of the invention.
Figure 5B:
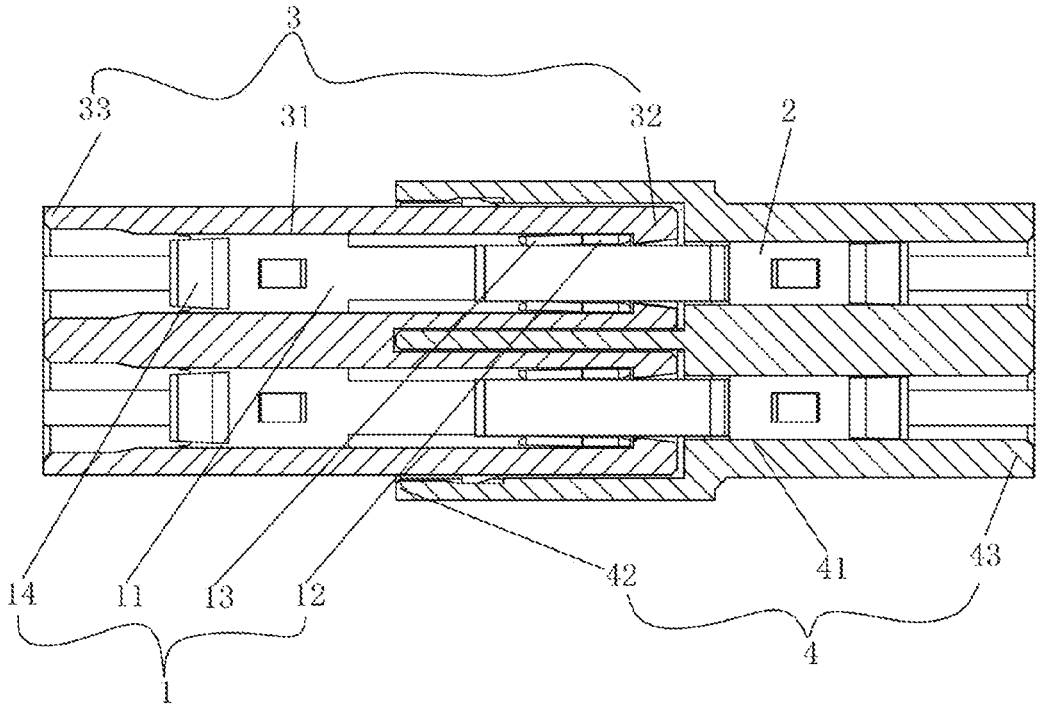
Figure 6A:
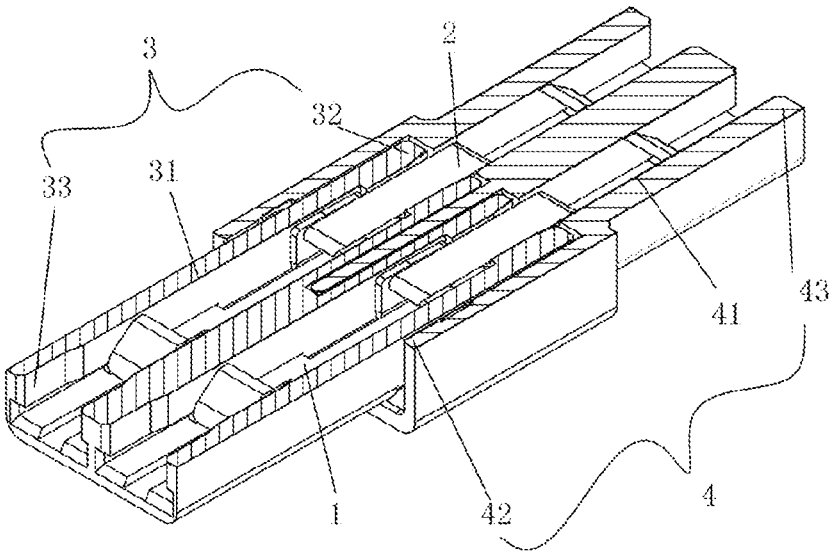
FIG. 6A and FIG. 6B are respectively a perspective sectional view and a top view of a male-female plug-in electrical connector using the female terminal in Embodiment 2 of the invention.
Figure 6B:
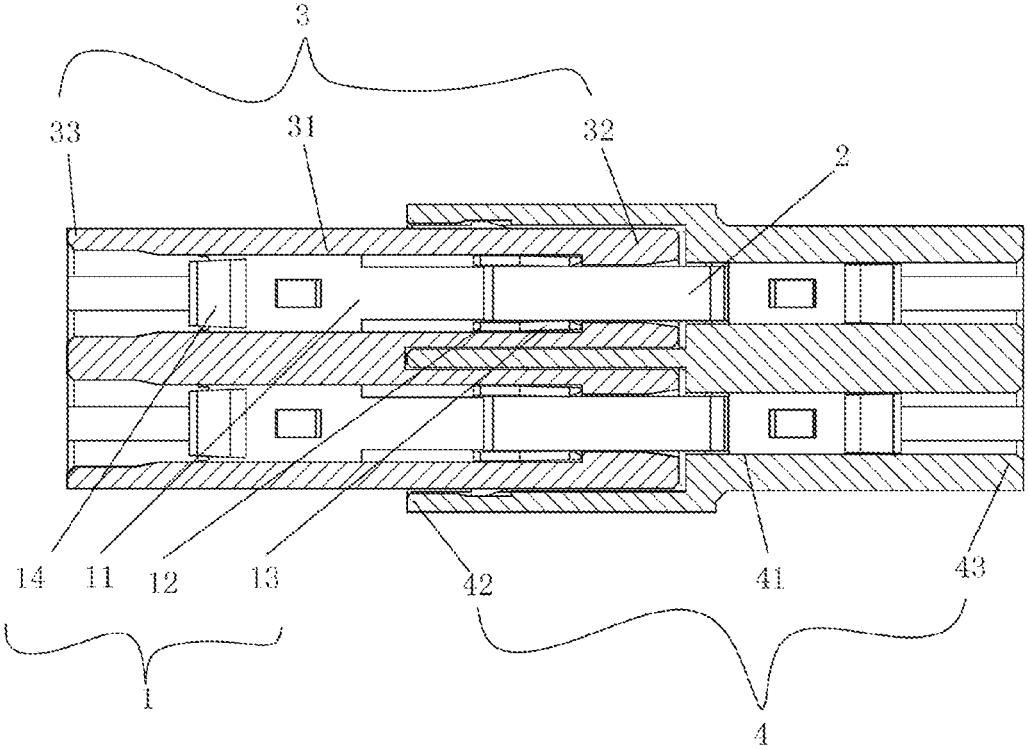

Wherein, the two elastic pieces 12 are perpendicular to the substrate 11, the elastic jaw 13 narrows down with respect to the width of the slot and provides a force to clamp the two sides of the male terminal 2. The specific configuration of the elastic jaw 13 can be, but is not limited to, the structure shown in the figures. For instance, as shown in FIG. 3A and FIG. 3B, the rear ends of the two elastic pieces 12 are disconnected from the substrate 11 and draw close to each other to form the elastic jaw 13. Or, as shown in FIG. 4A and FIG. 4B, the front ends of the two elastic pieces 12 are disconnected from the substrate 11 and draw close to each other to form the elastic jaw 13. Or, the middles of the two elastic pieces 12 draw close to each other to form the elastic jaw 13.

In order to conveniently insert the male terminal 2 into the slot between the two elastic pieces 12, guide-in faces 15 are formed at the foreparts of the two elastic pieces 12, and the male terminal 2 can be smoothly inserted into the slot between the two elastic pieces 12 with the guidance of the guide-in faces 15, so that assembly and connection are more convenient and faster.

In Embodiment 1 and Embodiment 2 shown in FIGS. 3A-4C, the female terminal external connection part 14 is a wire contact elastic piece which is formed by back bending of the rear end of the substrate 11 and is to be electrically connected with an external wire 5. Or, the female terminal external connection part 14 is a weld pin which is formed by bending of the rear end of the substrate 11 and is to be electrically connected with an external PCB, so that the female terminal can adapt to different products.

In addition, a barb 16 is formed on the substrate 11 of the stable female terminal 1 and is used for installation positioning of the female terminal 1.

As shown in FIGS. 5A-6B, a stable male-female plug-in electrical connector using the stable female terminal 1 comprises a male terminal 2, a female terminal 1, a male terminal insulation shell 4, and a female terminal insulation shell 3, wherein the male terminal insulation shell 4 is provided with a through cavity 41, and the female terminal insulation terminal 3 is provided with a through cavity 31; and plug ports 42 and 32 are formed in one ends (close to each other) of the male terminal insulation shell 4 and the female terminal insulation shell 3, and external connection ports 43 and 33 are formed in the other ends (ends away from each other) of the male terminal insulation shell 4 and the female terminal insulation shell 3.

The male terminal insulation shell 4 and the female terminal insulation shell 3 are able to move to be jointed via the plug ports 42 and 32 to realize electrical connection or to be separated from to cut off electrical connection.

At least one male terminal 2 is installed in the cavity 41 of the male terminal insulation shell 4, and at least one female terminal 1 is installed in the cavity of the female terminal insulation shell 3. The male terminal 2 is provided with a male terminal contact 21 which corresponds to the plug port 42 and is jointed in the plug port 42 to realize electrical connection. The male terminal 2 is further provided with a male terminal external connection part 22 which corresponds to the external connection port 43 and is to be electrically connected with the external wire or the PCB.

The key of the invention lies in that: the female terminal is the stable female terminal 1 provided with a substrate 11, wherein two side edges of the front end of the substrate 11 are turned to form two opposite elastic pieces 12, a slot allowing the male terminal 2 to be inserted therein is formed between the two elastic pieces 12, the two elastic pieces 12 draw close to each other to form an elastic jaw 13, and a male terminal external connection part 14 is formed at the rear end of the substrate 11. The structure of the stable female terminal has been detailed above and will not be repeated anymore herein.

When the male terminal insulation shell 4 and the female terminal insulation shell 3 move to be jointed, the male terminal contact 21 of the male terminal 2 is inserted into the slot between the two elastic pieces 12 of the female terminal 1, and the elastic jaw 13 formed by the two elastic pieces 12 clamps the two sides of the male terminal 2, and in this way, the male terminal and the female terminal are connected; and the contacts have a large positive force during connection, so that the male terminal 2 and the female terminal 1 can be in contact more stably and reliably, and larger currents can pass through the male terminal and the female terminal.

Figure 7A:
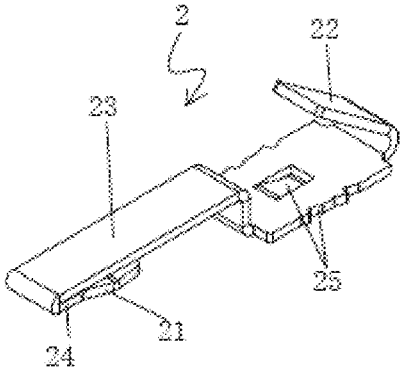
FIG. 7A, FIG. 7B and FIG. 7C are respectively a perspective view, a side view and a top view of a male terminal of the invention.
Figure 7B:
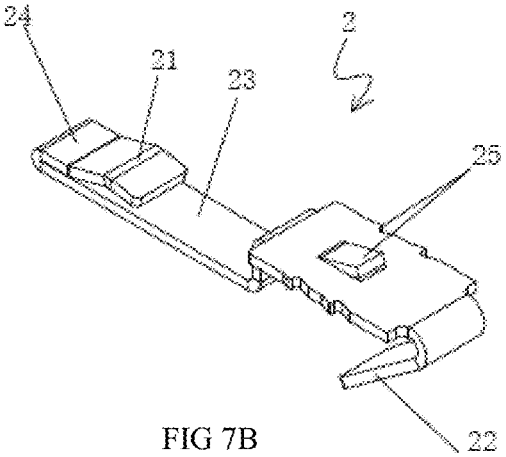
Figure 7C:
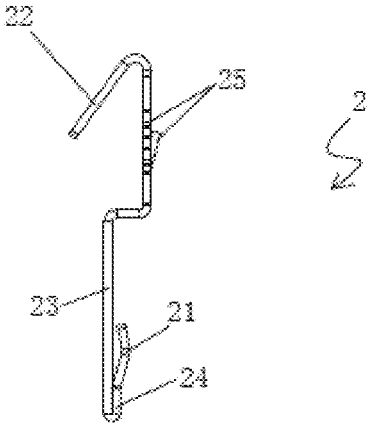
Figure 8A:
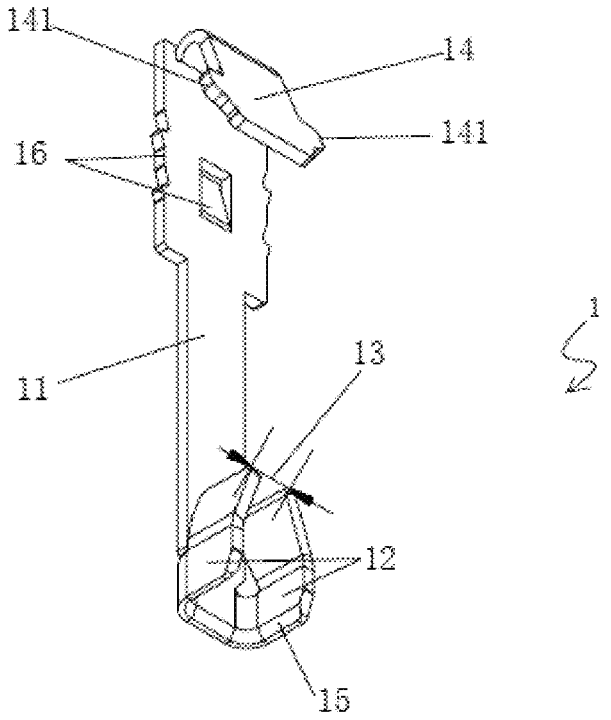
FIG. 8A and FIG. 8B are respectively a perspective view and top view of the female terminal in Embodiment 3 of the invention.
Figure 8B:
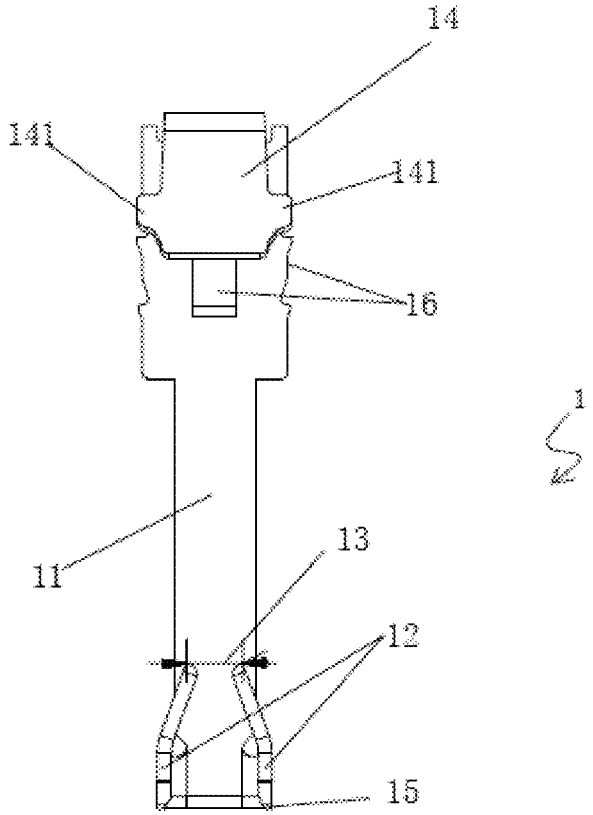
Figure 9A:
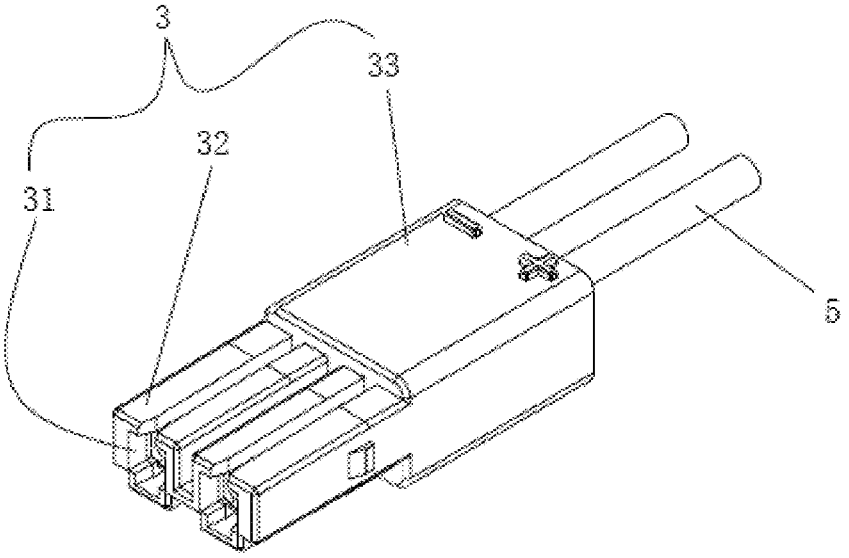
FIG. 9A, FIG. 9B, FIG. 9C, FIG. 9D, FIG. 9E and FIG. 9F are respectively a perspective view, a side view, a planar sectional view and perspective sectional view along E-E, and a planar sectional view and perspective sectional view along D-D of the female terminal in Embodiment 3 of the invention.
Figure 9B:
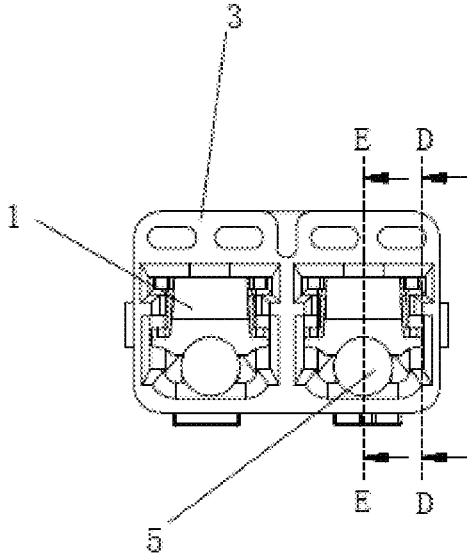
Figure 9C:
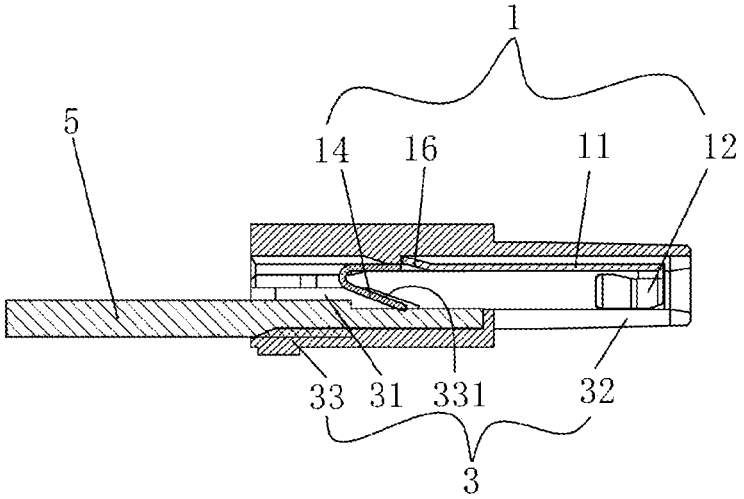
Figure 9D:
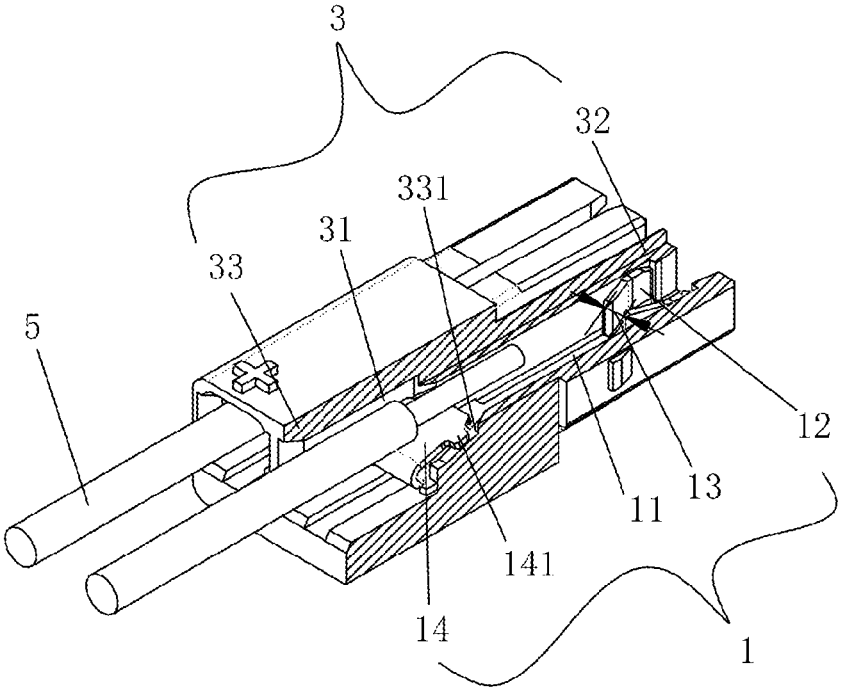
Figure 9E:
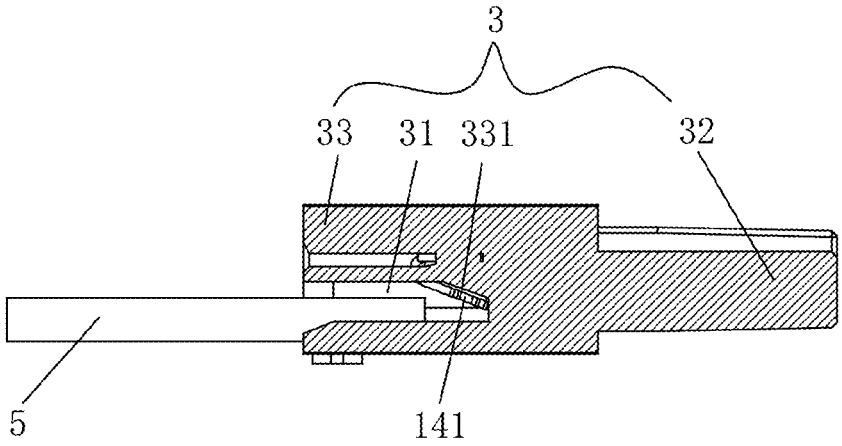
Figure 9F:
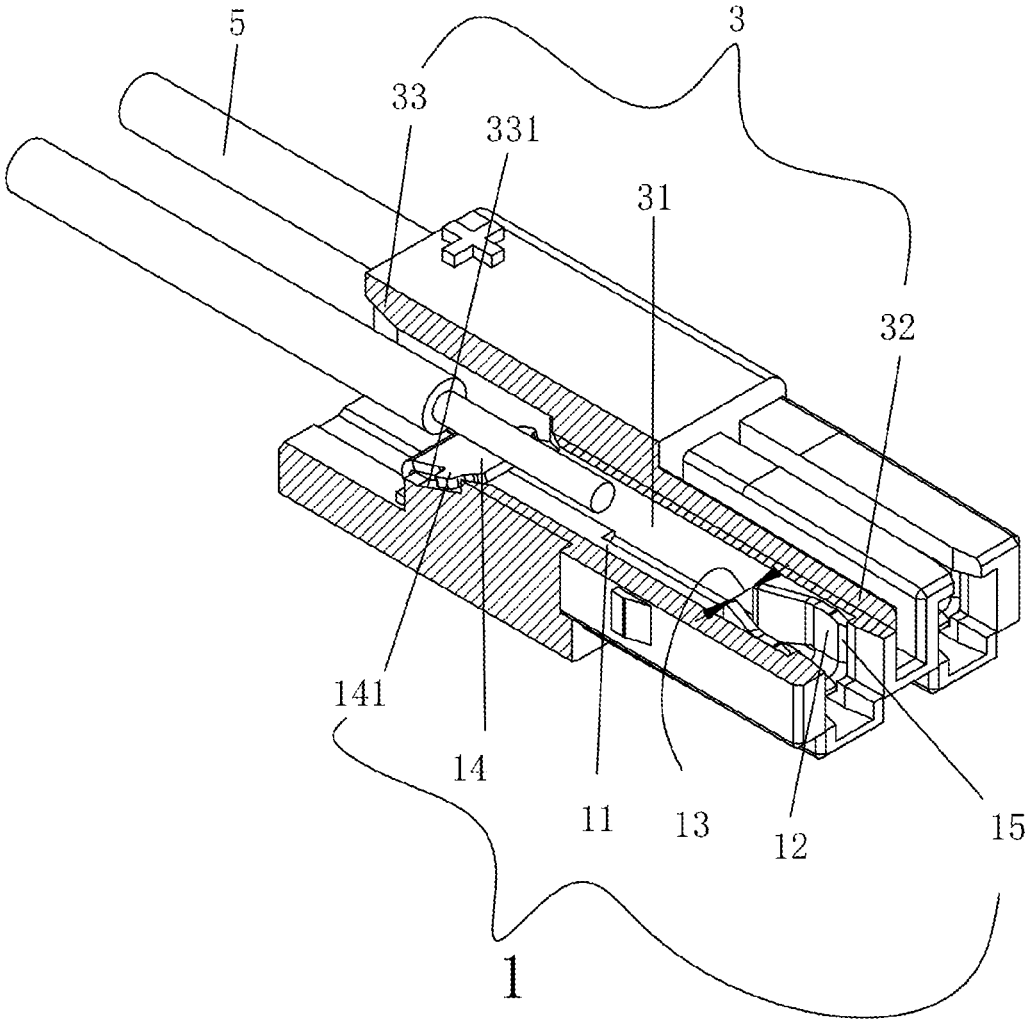
Figure 10A:
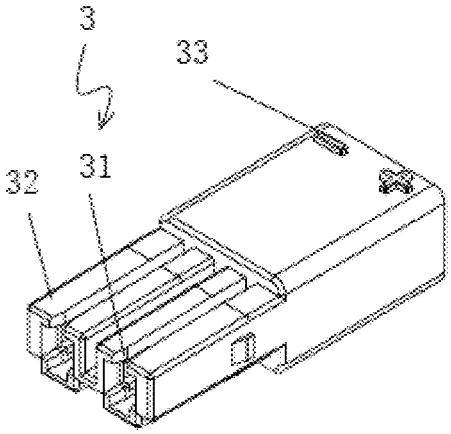
FIG. 10A, FIG. 10B and FIG. 10C are respectively a perspective view, a side view and a planar sectional view along I-I of a female terminal insulation shell suitable for the female terminal in Embodiment 3 of the invention.
Figure 10B:
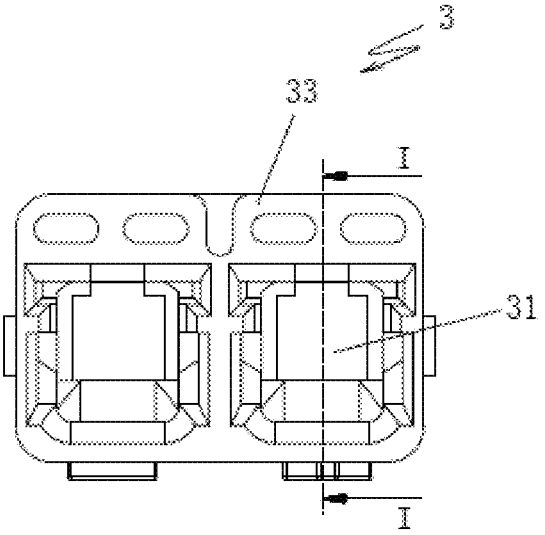
Figure 10C:
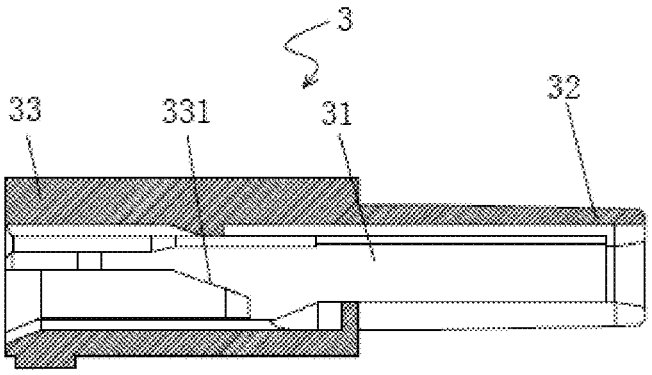
Figure 11A:
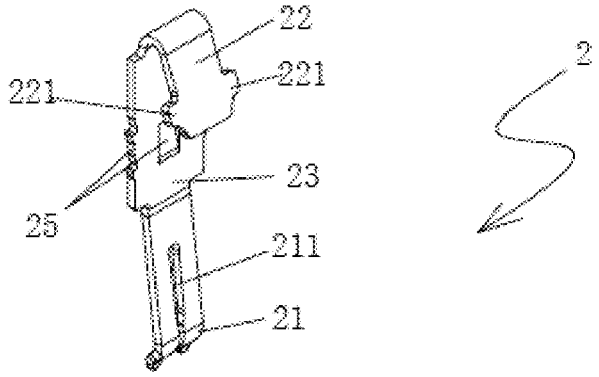
FIG. 11A, FIG. 11B and FIG. 11C are two perspective views and a top view of a male terminal of the invention.
Figure 11B:
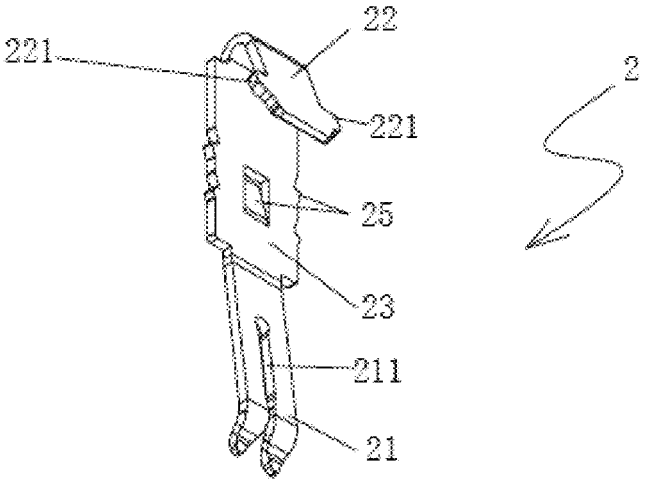
Figure 11C:
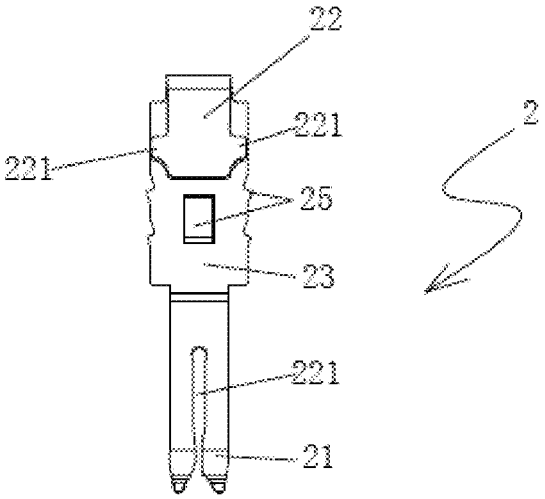
Figure 12A:
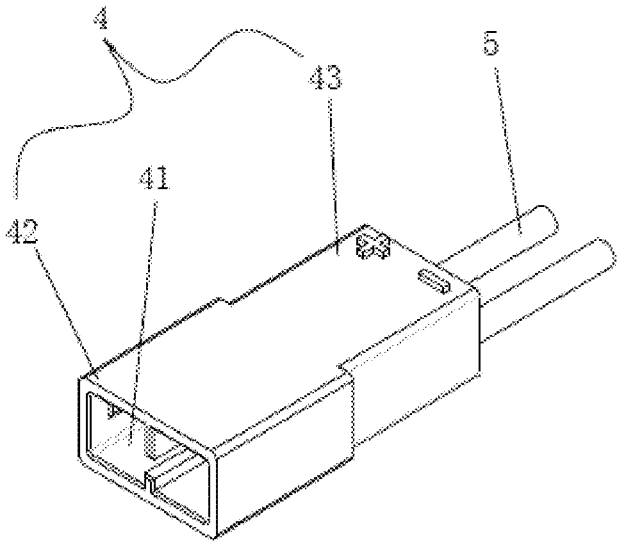
FIG. 12A, FIG. 12B, FIG. 12C, FIG. 12D, FIG. 12E and FIG. 12F are respectively a perspective view, a side view, a planar sectional view and perspective sectional view along G-G, and a planar sectional view and perspective sectional view along F-F of a male terminal installed in a male terminal insulation shell of the invention.
Figure 12B:
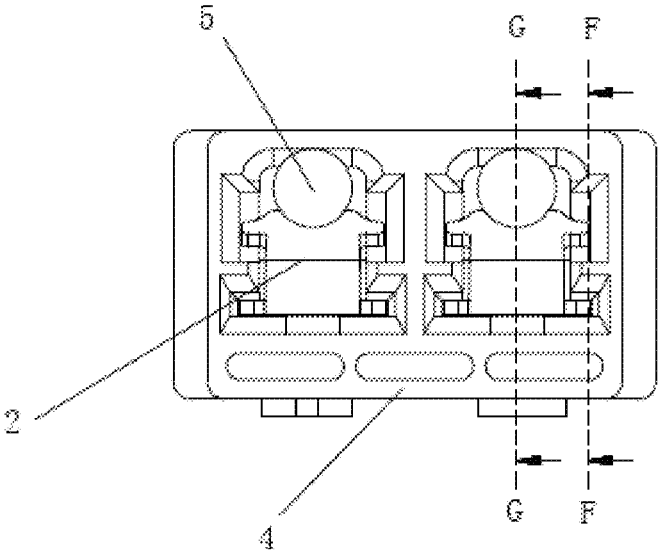
Figure 12C:
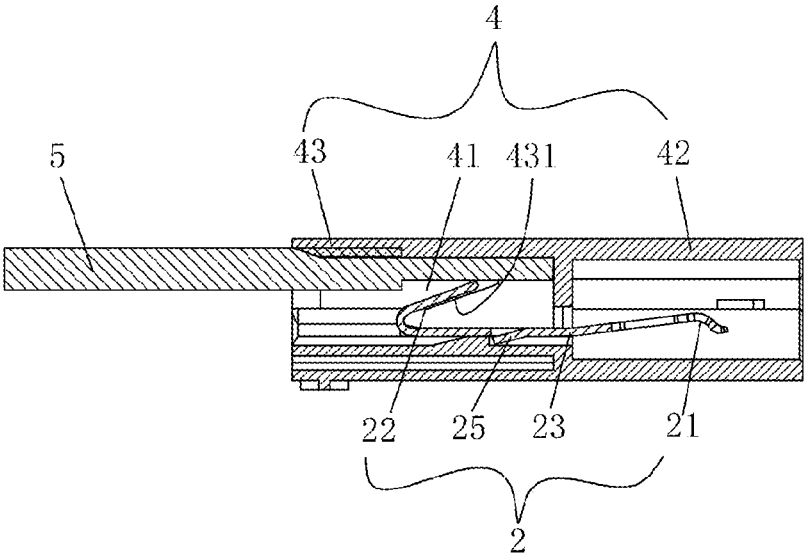
Figure 12D:
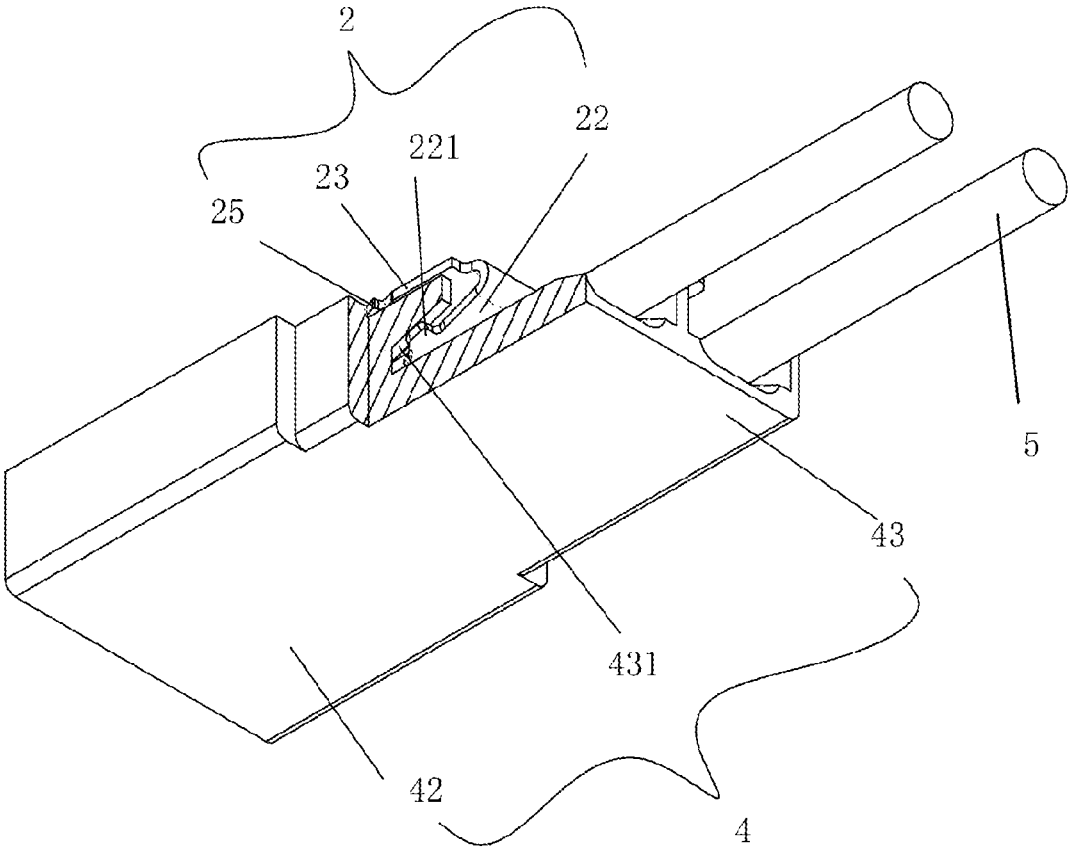
Figure 12E:
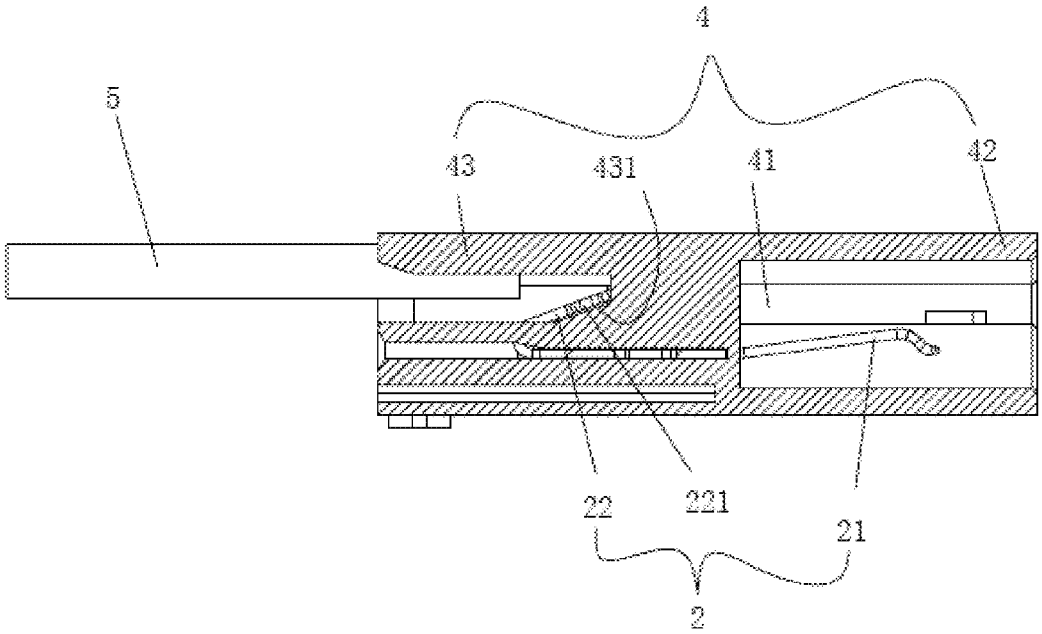
Figure 12F:
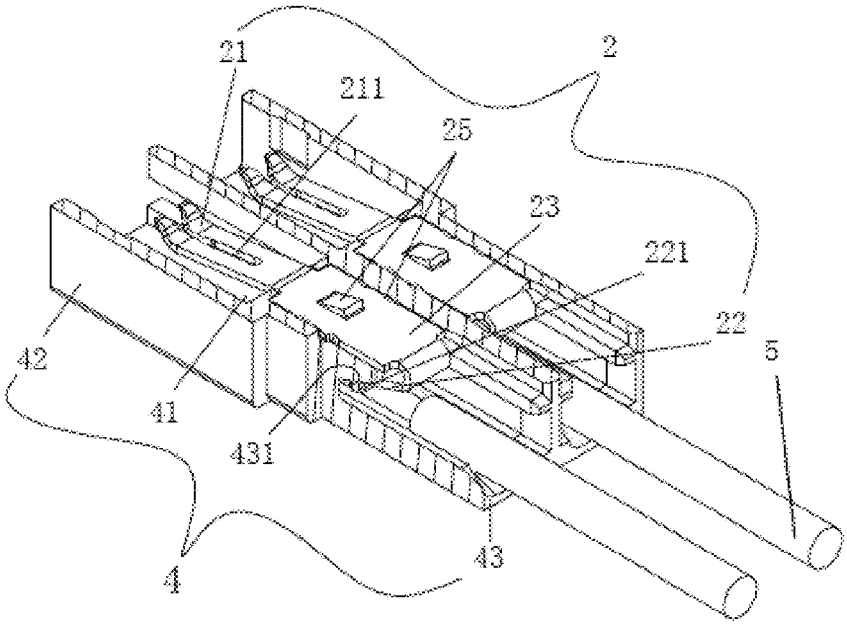
Figure 13A:
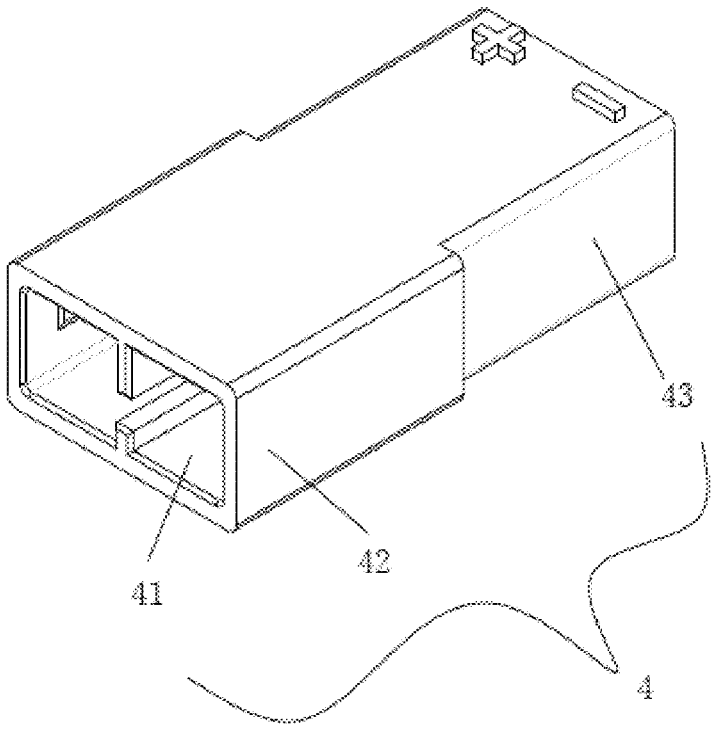
FIG. 13A, FIG. 13B, FIG. 13C and FIG. 13D are respectively a perspective view, a side view, a planar sectional view along H-H, and a planar sectional view along J-J of a male terminal insulation shell suitable for a male terminal of the invention.
Figure 13B:
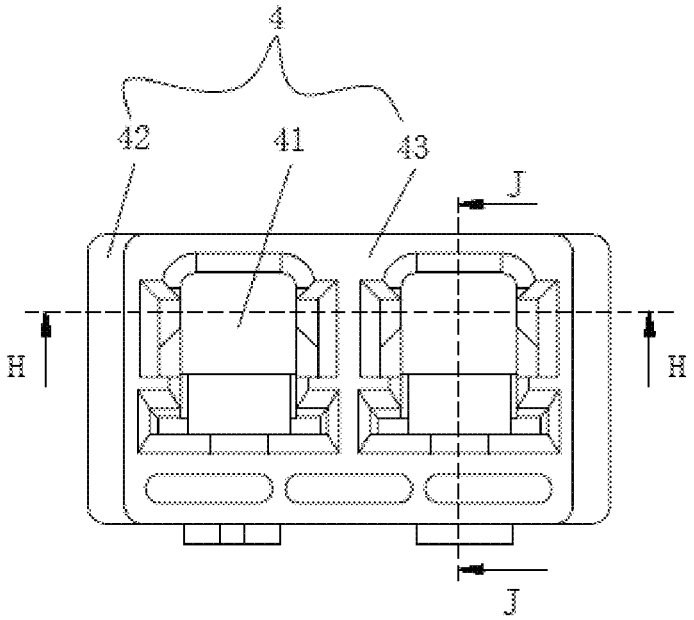
Figure 13C:
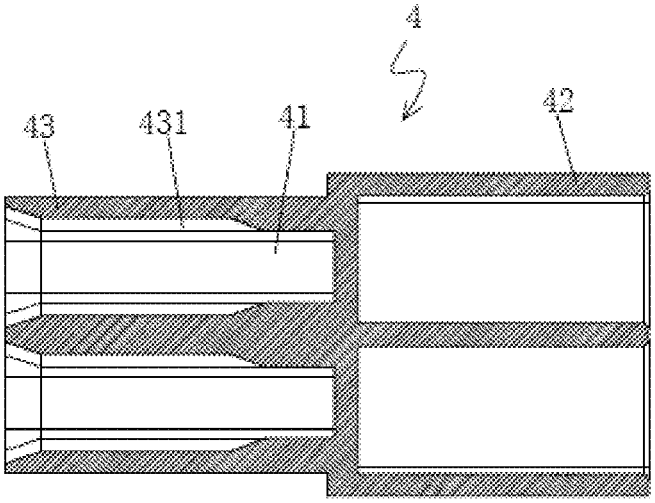
Figure 13D:
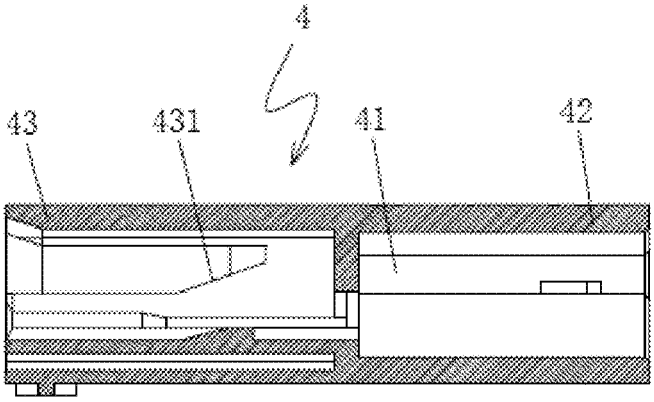
Figure 14A:
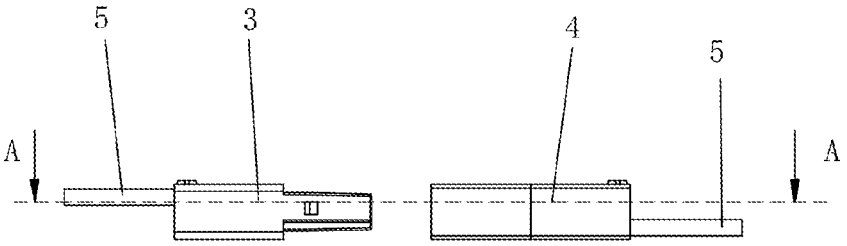
FIG. 14A and FIG. 14B are respectively an exploded view and a planar sectional view along A-A of a male-female plug-in electrical connector provided with the female terminal in Embodiment 3 and a male terminal matched with the female terminal.
Figure 14B:
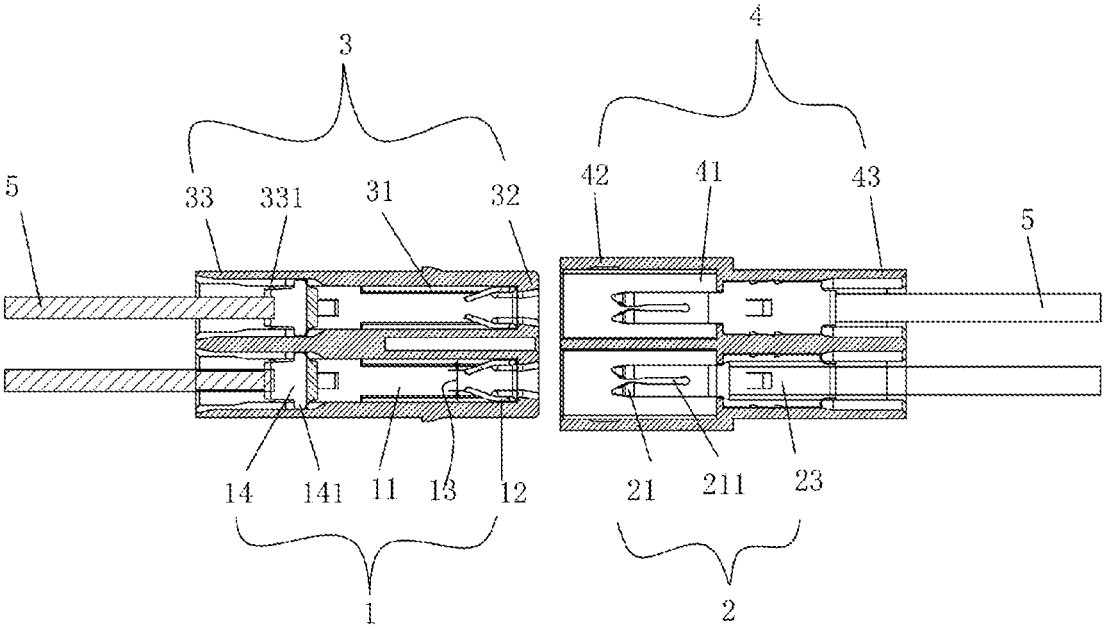

Preferably, as shown in FIGS. 7A-7C, the male terminal 2 is provided with a substrate 23, wherein the front end of the substrate 23 is extended and turned back to form an elastic piece 24, a convex male terminal contact 21 is formed on the elastic piece 24 and protrudes in an arc shape or a planar shape, and a male terminal external connection part 22 is formed at the rear end of the substrate 23. As shown in the figures, the male terminal connection part 22 is a wire contact elastic piece which is formed by back bending of the rear end of the substrate 23 and is to be elastically connected with an external wire 5. The male terminal connection part 22 is not limited to the structure shown in the figures. In order to adapt to different products, the male terminal external connection part 22 can also be a weld pin which is formed by bending of the rear end of the substrate 23 and is to be electrically connected with a PCB. When the male terminal insulation shell 4 and the female terminal insulation shell 3 move to be jointed (via the plug ports 42 and 32), the male terminal contact 21 of the male terminal 2 is inserted into the slot between the two elastic pieces 12 of the female terminal 1 and abuts against the bottom of the slot, so that contact-type electrical connection in one direction is realized; and meanwhile, the elastic jaw 13 formed by the two elastic pieces 12 clamps the two sides of the male terminal 2, so that contact-type electrical connection in another two directions is realized. In this way, contact-type electrical connection in three directions is achieved, the contact area is enlarged, the clamping force is large, and the stability and reliability of electrical connection are greatly improved.

Figure 2:
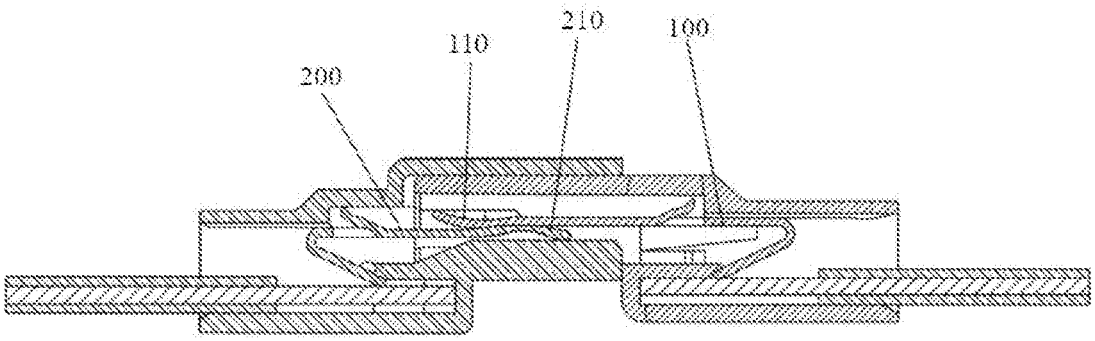

Or, the male terminal 2 is a common terminal (the structure shown in FIG. 1 and FIG. 2, or other structures), and the common terminal directly rises to form the male terminal contact 21 used for plugging. When the male terminal insulation shell 4 and the female terminal insulation shell 3 move to be jointed, the male terminal contact 21 of the male terminal 2 is inserted into the slot between the two elastic pieces 12 of the female terminal 1 and abuts the bottom of the slot, so that contact-type electrical connection in one direction is realized; and meanwhile, the elastic jaw 13 formed by the two elastic pieces 12 clamps the two sides of the male terminal 2, so that contact-type electrical connection in another two directions is realized. In this way, contact-type electrical connection in three directions is achieved.

In order to fix the male terminal 2 to the male terminal insulation shell 4 and to fix the male terminal 1 to the male terminal insulation shell 3, barbs 25 and 16 are respectively formed on the male terminal 2 and the female terminal 1 and are matched with the inner walls of the corresponding cavities 41 and 31 to be fixed in the cavities 41 and 31.

In addition, the invention is further optimized, as shown in FIGS. 8A-14B.

If the female terminal external connection part 14 is a wire contact elastic piece which is formed by back bending of the rear end of the substrate 11, fin(s) 141 can be formed on side edge(s) of the wire contact elastic piece of the female terminal external connection part 14 of the stable female terminal 1. Particularly, both side edges of the wire contact elastic piece are formed with fins 141, or only one side edge of the wire contact elastic piece is provided with a fin. This design is obtained by further optimization of Embodiment 1 shown in FIGS. 3A-3C. In this design, the stable female terminal 1 is still provided with the substrate 11, the elastic pieces 12, the elastic jaw 13, the female terminal external connection part 14, the guide-in faces 16 and the barb 331, and unnecessary details will not be given anymore herein. Correspondingly, an oblique step 331 is formed on the inner side of the external connection port 33 of the female terminal insulation shell 3 and can support the fin(s) 141 on the side edge(s) of the wire contact elastic piece of the female terminal external connection part 14, so that the wire contact elastic piece of the female terminal external connection part 14 is prevented from being compressively deformed by the wire 5 in contact with the wire contact elastic piece, which may otherwise cause a failure; and through the cooperation of the fin(s) 141 and the step 331, the wire contact elastic piece of the female terminal external connection part 14 is protected, and accordingly, good contact between the wire contact elastic piece of the female terminal external connection part 14 and the wire 5 is guaranteed.

Similarly, if the male terminal external connection part 22 is a wire contact elastic piece which is formed by back bending of the rear end of the substrate 23, fin(s) 221 can be formed on side edge(s) of the wire contact elastic piece of the male terminal external connection part 22 of the male terminal 2. Particularly, both side edges of the wire contact elastic piece are formed with fins 221, or only one side edge of the wire contact elastic piece is provided with a fin. In this design, the male terminal 1 is still provided with the male terminal contact 21, the male terminal external connection part 22, the substrate 23 and the barb 25, and is matched with the female terminal 1 in the way mentioned above, and unnecessary details will not be given anymore herein. Correspondingly, an oblique step 431 is formed on the inner side of the external connection port 43 of the male terminal insulation shell 4 and can support the fin(s) 221 on the side edge(s) of the wire contact elastic piece of the male terminal external connection part 22, so that the wire contact elastic piece of the male terminal external connection part 22 is prevented from being compressively deformed by the wire 5 in contact with the wire contact elastic piece, which may otherwise cause a failure; and through the cooperation of the fin(s) 221 and the step 431, the wire contact elastic piece of the male terminal external connection part 22 is protected, and accordingly, good contact between the wire contact elastic piece of the male terminal external connection part 22 and the wire 5 is guaranteed.

Furthermore, a sectional groove is formed in an end, which is inserted into the elastic jaw 13 of the female terminal 1, of the male terminal 2. The sectional groove 211 can improve the elasticity of the male terminal 2, so that the contact elasticity of the male terminal 2 and the female terminal 2 is made better, and the electrical connection stability is further improved.

The above embodiments are only specific ones of the invention, and are not intended to limit the protection scope of the invention. All equivalent variations achieved based on the design thought of the invention should fall within the protection scope of the invention.

What is claimed is:

1. A stable female terminal, comprising:

a substrate, wherein:

two side edges of a front end of the substrate are turned to form two opposite elastic pieces perpendicular to the substrate, a slot allowing a male terminal to be inserted therein is formed between the two opposite elastic pieces, the two opposite elastic pieces draw close to each other to form an elastic jaw used for clamping two sides of the male terminal inserted into the slot, and a female terminal external connection part is formed at a rear end of the substrate.

2. The stable female terminal according to claim 1, wherein front ends of the two opposite elastic pieces are disconnected from the substrate and draw close to each other to form the elastic jaw.

3. The stable female terminal according to claim 1, wherein rear ends of the two opposite elastic pieces are disconnected from the substrate and draw close to each other to form the elastic jaw.

4. The stable female terminal according to claim 1, wherein guide-in faces are formed at foreparts of the two opposite elastic pieces to enable the male terminal to be inserted between the two opposite elastic pieces.

5. The stable female terminal according to claim 1, wherein the female terminal external connection part is a wire contact elastic piece which is formed by back bending of the rear end of the substrate and is configured to be electrically connected with an external wire.

6. The stable female terminal according to claim 5, wherein at least one side edge of the wire contact elastic piece of the female terminal external connection part is formed with a fin.

7. The stable female terminal according to claim 1, wherein the female terminal external connection part is a weld pin which is formed by bending of the rear end of the substrate and is configured to be electrically connected with a printed circuit board (PCB).

8. The stable female terminal according to claim 1, wherein a barb used for installation positioning is formed on the substrate.

9. A stable male-female plug-in electrical connector, comprising:

the male terminal, a female terminal, a male terminal insulation shell, and a female terminal insulation shell, wherein:

the male terminal insulation shell and the female terminal insulation shell are each provided with a through cavity, plug ports are formed in first ends of the male terminal insulation shell and the female terminal insulation shell, external connection ports are formed in second ends of the male terminal insulation shell and the female terminal insulation shell, the male terminal insulation shell and the female terminal insulation shell are configured to move to be joined or separated via the plug ports, the male terminal is installed in the through cavity of the male terminal insulation shell, the female terminal is installed in the through cavity of the female terminal insulation shell, the male terminal is provided with a male terminal contact which corresponds to the plug port of the male terminal insulation shell and is used for plugging and a male terminal external connection part which corresponds to the external connection port of the male terminal insulation shell, the female terminal is the stable female terminal according to claim 1, and when the male terminal insulation shell and the female terminal insulation shell move to be joined, the male terminal contact of the male terminal is inserted into the slot between the two opposite elastic pieces, and the elastic jaw formed by the two opposite elastic pieces clamp the two sides of the male terminal.

10. The stable male-female plug-in electrical connector according to claim 9, wherein:

the female terminal external connection part is a wire contact elastic piece which is formed by back bending of the rear end of the substrate and is configured to be electrically connected with an external wire, at least one side edge of the wire contact elastic piece of the female terminal external connection part is formed with a fin, and an oblique step is formed on an inner side of the external connection port of the female terminal insulation shell to support the fin on the at least one side edge of the wire contact elastic piece.

11. The stable male-female plug-in electrical connector according to claim 9, wherein:

the male terminal comprises a second substrate, a front edge of a front end of the second substrate is extended and turned back to form an elastic piece, the male terminal contact is convex-shaped and is formed on the elastic piece, the male terminal external connection part is formed at a rear end of the second substrate, and when the male terminal insulation shell and the female terminal insulation shell move to be joined, the male terminal contact of the male terminal is inserted into the slot between the two opposite elastic pieces and abuts against a bottom of the slot, and the elastic jaw formed by the two opposite elastic pieces clamps the two sides of the male terminal, so that contact-type electrical connection in three directions is realized.

12. The stable male-female plug-in electrical connector according to claim 9, wherein each of the two opposite elastic pieces protrudes in an arc shape or a planar shape.

13. The stable male-female plug-in electrical connector according to claim 11, wherein the male terminal external connection part is a wire contact elastic piece which is formed by back bending of the rear end of the second substrate and is configured to be electrically connected with an external wire.

14. The stable male-female plug-in electrical connector according to claim 13, wherein:

at least one side edge of the wire contact elastic piece of the male terminal external connection part is formed with a fin, and an oblique step is formed on an inner side of the external connection port of the male terminal insulation shell to support the fin on the at least one side edge of the wire contact elastic piece.

15. The stable male-female plug-in electrical connector according to claim 11, wherein the male terminal external connection part is a weld pin which is formed by bending of the rear end of the second substrate and is to be electrically connected with a printed circuit board (PCB).

16. The stable male-female plug-in electrical connector according to claim 9, wherein:

the male terminal is a common terminal which directly rises to form the male terminal contact used for plugging, and when the male terminal insulation shell and the female terminal insulation shell move to be joined, the male terminal contact of the male terminal is inserted into the slot between the two opposite elastic pieces and abuts against a bottom of the slot, and the elastic jaw formed by the two opposite elastic pieces clamps the two sides of the male terminal, so that contact-type electrical connection in three directions is realized.

17. The stable male-female plug-in electrical connector according to claim 9, wherein a sectional groove is formed in an end, which is inserted into the elastic jaw formed by the two opposite elastic pieces, of the male terminal.

18. The stable female terminal according to claim 1, wherein the slot is defined by the two opposite elastic pieces and a portion of the substrate extending between the two opposite elastic pieces.

* * * * *